US008998193B2

(12) United States Patent
Barrer

(10) Patent No.: US 8,998,193 B2
(45) Date of Patent: Apr. 7, 2015

(54) DEVICE AND METHOD FOR CONVEYING SHEETS AND CONVEYOR SYSTEM

(71) Applicant: Multigraf AG, Muri (CH)

(72) Inventor: Robert Barrer, Muri (CH)

(73) Assignee: Multigraf AG, Muri (CH)

( * ) Notice: Subject to any disclaimer, the term of this patent is extended or adjusted under 35 U.S.C. 154(b) by 0 days.

(21) Appl. No.: 14/029,229

(22) Filed: Sep. 17, 2013

(65) Prior Publication Data

US 2014/0084533 A1 Mar. 27, 2014

(30) Foreign Application Priority Data

Sep. 25, 2012 (EP) ..... 12185937

(51) Int. Cl.

| | |
|---|---|
| ***B65H 5/22*** | (2006.01) |
| ***B65H 3/12*** | (2006.01) |
| ***B65H 29/24*** | (2006.01) |
| ***B65H 29/60*** | (2006.01) |
| ***B65H 7/00*** | (2006.01) |
| ***B65H 7/16*** | (2006.01) |
| ***B65H 3/44*** | (2006.01) |

(Continued)

(52) U.S. Cl.

CPC ..... *B65H 3/124* (2013.01); *B65H 29/242* (2013.01); *B65H 29/60* (2013.01); *B65H 3/128* (2013.01); *B65H 5/224* (2013.01); *B65H 5/226* (2013.01); *B65H 7/00* (2013.01); *B65H 2301/4213* (2013.01); *B65H 2301/4482* (2013.01); *B65H 2402/10* (2013.01); *B65H 2405/15* (2013.01); *B65H 7/16* (2013.01); *B65H 3/446* (2013.01); *B65H 5/26* (2013.01); *B65H 2404/2691* (2013.01); *B65H 2406/323* (2013.01); *B65H 2801/06* (2013.01); *B65H 83/025* (2013.01)

(58) Field of Classification Search

CPC ..... B65H 5/085; B65H 5/224; B65H 7/16; B65H 7/20; B65H 29/242

USPC ..... 271/3.01, 3.03, 3.08, 3.11, 276, 196, 271/197

See application file for complete search history.

(56) References Cited

U.S. PATENT DOCUMENTS

| | | | | |
|---|---|---|---|---|
| 3,395,915 | A * | 8/1968 | Clausen et al. | 271/197 |
| 4,824,092 | A * | 4/1989 | Kriefall et al. | 271/183 |

(Continued)

FOREIGN PATENT DOCUMENTS

| | | |
|---|---|---|
| DE | 10 2007 024 916 A1 | 12/2008 |
| EP | 0 807 593 A2 | 11/1997 |
| JP | A-04-327996 | 11/1992 |

OTHER PUBLICATIONS

European Search Report issued in Application No. 12185937.5; Dated Mar. 6, 2013 (With Translation).

*Primary Examiner* — David H Bollinger
(74) *Attorney, Agent, or Firm* — Oliff PLC

(57) ABSTRACT

According to the invention, in the transport path between the input device and the output device, at least one intermediate buffer is arranged that serves as input device and as output device. The input device, the output device and the intermediate buffer are positioned adjacent to the conveyor belt and operated by the control device in such a way, that sheets forwarded from the input device or sheets stocked in the intermediate buffer are coupleable pneumatically to the lower side of the conveyor belt, and that sheets pneumatically attached to the lower side of the conveyor belt are selectively decoupleable at the intermediate buffer or at the output device.

11 Claims, 7 Drawing Sheets

(51) Int. Cl.
*B65H 5/26* (2006.01)
*B65H 83/02* (2006.01)

(56) References Cited

U.S. PATENT DOCUMENTS 4,921,240 A * 5/1990 Watson ..... 271/245
5,201,513 A * 4/1993 Mion ..... 271/180
5,564,693 A * 10/1996 Elkis et al. ..... 271/276
5,979,890 A 11/1999 Fujimaki et al.
7,296,792 B2 * 11/2007 Kondratuk et al. ..... 271/197
8,047,535 B2 * 11/2011 Nishimura et al. ..... 271/197
2005/0061627 A1 * 3/2005 Muller ..... 198/689.1
2005/0156376 A1 * 7/2005 Kondratuk et al. ..... 271/276
2007/0120934 A1 5/2007 Lang
2008/0157466 A1 7/2008 Fukatsu et al.
2010/0148422 A1 * 6/2010 Kawaguchi et al. ..... 271/3.22
2010/0213666 A1 * 8/2010 Harney et al. ..... 271/276

* cited by examiner

DEVICE AND METHOD FOR CONVEYING SHEETS AND CONVEYOR SYSTEM

FIELD OF THE INVENTION

The invention claimed and disclosed herein pertains to a device and a method for transporting sheet-like material, particularly sheets of media, such as paper, cardboard or plastic foils from at least one source to at least one destination. The invention further pertains to a conveyor system comprising at least one printing line.

BACKGROUND OF THE INVENTION

In the printing industry, printing lines with a plurality of workstations are used, with which sheet-like material can be processed. Processing steps include for example printing, coating, coupling, creasing, perforating and/or folding. A printing line with a plurality of workstations is disclosed for example in [1], JP4327996. Typically, printing lines of this kind are adapted to precisely defined processes that subsequently cannot be altered without changing the structure of the printing line. Often, all sheets are transported and processed by the printing line in the same manner. Devices installed in such a printing line are adapted to a specific task or function required at a given point within the printing line.

A printing line can also be integrated into a unitary processing unit such as the sheet stacking apparatus and image forming apparatus disclosed in [2], US2008157466A1. The modules of this apparatus are adapted to individual tasks and are firmly integrated in the apparatus.

From [3], US2007120934A1, a mixed output printing system is known that comprises a first and a second printing unit that deliver paper sheets to a merging module, that comprises a sheet rotor which can turn the sheets by 90°. Further, an input buffer, from which sheets can be taken, and an output buffer, on which sheets can be stacked, are provided. This system allows transferring sheets from a first printing line to a second printing line aligned perpendicularly thereto. The merging module comprises controllable deflectors and at least one merging path, along which the sheets can be merged, and at least one path, along which sheets can be transported directly from a first workstation to a second workstation. For obtaining several transport paths within the system a plurality of roller pairs is provided, which guide the sheets along the selected paths. Hence, conveying devices of this kind exhibit a high mechanical complexity and, in spite of additional functions such as a by-pass function, a relatively small flexibility.

Besides the complex mechanical system and the costs related thereto, large rooms are required for this conveyor technology.

[4], U.S. Pat. No. 5,979,890A, discloses a sheet transfer system that uses a conveyor belt which attracts the back side of the sheet under vacuum along a conveyance passage including a bent portion. With the conveyor belt, sheets can selectively be transported to a first or to a second sheet sorter. A first conveyor belt is used to transport sheets vertically down at a related sorter. A second conveyor belt is used for transporting a sheet past the first sorter to the second sorter. Along this transport path the sheets are transported on top of the second conveyor belt, which is arranged between the sheets and the first sorter that is by-passed. Hence, this system requires various conveyor belts for transporting sheets to different destinations.

Further, also in this system sheets are transported from first to second processing units that are adapted to a specific function.

Further for directing the sheets to the related destinations various air blowers are provided that can direct an air flow against the upper surface of the conveyor belt at a bent portion of a conveyance passage so that the sheet can be bent along the surface of the conveyor belt and can either be transported along the first conveyor belt down the first sorter or along the second conveyor belt past the first sorter. The system therefore requires space for the rather voluminous air blowers which allow forcing a sheet into a desired direction. Further, the air flows generated by various air blowers within a device may cause interferences and related disturbances. Further, such air blowers which act from a distance require considerable energy, when generating the required air flows.

Modules for transporting sheets with conveyor belts that allow the application of air suction are known from [5], DE102007024916A1.

The present invention is therefore based on the object of providing an improved device and an improved method for conveying sheet-like material. Further, an improved conveyor system with at least one processing line shall be created.

In particular a device for conveying sheet-like material shall be defined, which allows creating two or more transport paths and conveying functions in a simple manner and with reduced volume so that it can be installed in small rooms.

The inventive conveyor device shall allow implementing two or more process functions, such as functions for picking up, delivering, merging, sorting, deflecting and distributing sheets in a simple and efficient manner.

The transported sheets shall be treated smoothly so that damages are avoided. Further the transported sheets shall be sensed optically in order to optimally control the conveying process.

It shall be possible to create conveying systems with at least one printing line or with a plurality of printing lines that cross one another with reduced efforts and reduced space requirements.

It shall be possible to use inventive conveying devices advantageously in one or more positions within a printing line, in order to locally implement one or more of the above-mentioned process functions. Thereby, an adaptation to different process functions shall be implementable by a simple change of the operation mode with the installed software. Hence, with inventive conveyor devices, it shall be possible to construct and change printing lines with reduced effort.

SUMMARY OF THE INVENTION

The defined objects are reached with a conveyor device according to claim 1, a conveyor system according to claim 9 and a method according to claim 11. Preferred embodiments of the invention are defined in further claims The inventive device, which serves for conveying sheet-like material, such as sheets of paper, cardboard or plastic, along a transport path, comprises a control device for controlling a conveyor process, at least one conveyor belt provided with air channels and at least one pneumatic device that is connected to the control device and to the air channels of the conveyor belt, so that sheets forwarded from an input device can be coupled pneumatically to the conveyor belt and can be decoupled from the conveyor belt at an output device.

According to the invention, in the transport path between the input device and the output device, at least one intermediate buffer is arranged that serves as input device and as output device. The input device, the output device and the intermediate buffer are positioned adjacent to the conveyor belt and operated by the control device in such a way, that sheets forwarded from the input device or sheets stocked in the intermediate buffer are coupleable pneumatically to the lower side of the conveyor belt, and that sheets pneumatically attached to the lower side of the conveyor belt are selectively decoupleable at the intermediate buffer or at the output device.

Hence, the inventive conveyor device allows advantageous transportation of the sheets that can selectively be picked up from different sources at different positions, that, coupled to the lower side of the conveyor belt, can be transported, and can selectively be decoupled from the lower side of the conveyor belt at different positions and can be forwarded further.

Typically, endless conveyor belts are used that have an inner and an outer side. A sheet pneumatically attached to the outer side of a conveyor belt is travelling from the upper side of the conveyor belt to the lower side of the conveyor belt and back to the upper side with one with each round of the conveyor belt. The conveyor belts are driven by a drive device. A conveyor belt, the drive device and optionally a pneumatic unit form a conveyor unit. Below reference is made typically directly to the conveyor belts.

The inventive conveyor device can be installed at the input side of a workstation and can pick up sheets from a staple or a sheet buffer and can forward sheets to the workstation.

The same conveyor device can be installed at the output side of the workstation and can receive, transport and selectively place processed sheets on a staple or transport processed sheets via an output device further, e.g. to a second workstation.

The inventive conveyor device allows selectively picking up sheets from one or a plurality of sources, particularly from sheet buffers, and to transport sheets to one or a plurality of destinations, particularly sheet buffers and workstations.

Further, sheets can be exchanged between a plurality of sources, particularly sheet buffers, in order to sort sheets. Thereby an intelligent sorting can be implemented advantageously, that involves identifying sheets taken from a sheet buffer and for transporting the sheets depending on the determined identity, e.g. to a defined workstation or to a defined sheet buffer. This advantageously allows sorting of sheets. E.g., identical sheets can be forwarded to the same sheet buffer. Alternatively, sheets taken from different sheet buffers can be stored in a desired sequence in a further sheet buffer. The order of a sheet sequence can also be inverted without additional effort. Further, a sheet delivered by a workstation, e.g. a printer, can also bypass one or a plurality of sheet buffers and can be delivered directly to the next or a further workstation downstream.

The inventive conveyor device can therefore be used for providing various process functions, such as functions for picking up, delivering, merging, sorting, turning, deflecting and distributing sheets. Furthermore the inventive device allows bi-directional transportation of the processed sheets without additional effort.

The inventive conveyor device can universally and advantageously be installed at several points within a processing line particularly a printing line or within a conveyor system that encompasses a plurality of printing lines. Particularly advantageous is the installation of an inventive conveyor device at the crossing points of printing lines. The conveyor device can selectively act as a so-called feeder, i.e. as a device that draws sheets from a staple, or as a so-called stacker, i.e. as a device that forwards sheets to a staple. Due to the universal applicability of the inventive conveyor device, the traditional designations for the inventive conveyor device are individually selected according the present application. In the event that the inventive conveyor device is installed at the input of a printer, the technical term "feeder" is appropriate. In the event that the same conveyor device is installed at the output of the printer, the technical term "stacker" is appropriate. In the event that a mixed operation between two workstations is implemented, then the technical term "feeder-stacker" is appropriate. The conveyor device can also execute both functions, i.e. forwarding sheets to a staple or drawing sheets from the same staple. Further, the inventive conveyor device can incorporate and operate one or a plurality of sheet buffers, which can selectively be used or bypassed. Hence, sheets can also bypass the sheet buffers and can be delivered to different destinations, so that besides the feeder-function and stacker-function also a by-pass-function can be implemented. Hence, in a preferred embodiment a single inventive conveyor device is installed between two workstations, which serves for the first workstation as stacker and for the second workstation as feeder, or selectively as transfer unit or by-pass-unit.

Further, with the inventive conveyor device, sheets held at the lower side of the conveyor belt can be transported bi-directionally, in one direction and in the opposite direction. In preferred embodiments, sheets held at the lower side of the conveyor belt can be forwarded to the upper side of the conveyor belt and thus can be turned by 180°. There, the sheets can be decoupled and can be moved vertically or laterally. In preferred embodiments the sheets are forwarded to the upper side of the conveyor belt and are then moved downwards, e.g. towards a sheet buffer. This can be performed in a simple manner, by using two separate pneumatic conveyor belts that are aligned in a mutual distance that allows moving a sheet that has been forwarded to the upper side of the conveyor belts downwards between the two conveyor belts.

Sheets can be released from the conveyor belt by interrupting or inverting the air flow that is supplied to the conveyor belt. Thereby, the sheets are not only decoupled from the conveyor belt, but also conveyed downwards or upwards. In order to move the sheets quickly to the destination, preferably an additional transfer blower is used that emits an air flow, which delivers the sheets for example to a sheet buffer.

Decoupling the sheets from the conveyor belt or picking up sheets from a sheet buffer can further be supported by mechanical devices such as a lever arm that can grasp, lift and lower a sheet. For lifting sheets, preferably lever arms are used that comprise suction elements. Alternatively, for picking up and delivering sheets the sheet buffer is lifted or the conveyor belt or the parallel conveyor belts are lowered.

In a preferred embodiment, a duct is arranged above the sheet buffers, into which sheets can be dropped. After a sheet has been transported by the conveyor belt, i.e. the conveyor device to the duct entrance, the air flow in the air channels of the conveyor belt is inverted and the pneumatically held sheets are decoupled and blown into the duct.

In a further preferred embodiment, a plurality of conveyor belts is provided that are arranged serially behind one another, so that these conveyor belts can at the same time perform different functions. Preferably, the conveyor belts are designed and arranged in such a way, e.g. supported vertically movable, that they can selectively pick up and put down sheets. Conveyor belts are preferably adapted to the maximum sheet-length and surveyed by means of optical sensors. As soon as the completed delivery of a sheet to a conveyor belt has been signalled, the conveyor belt can be lowered to a sheet buffer and the sheet can be decoupled and discharged.

In a preferred embodiment the conveyor device comprises a rotor unit, which can grasp delivered sheets and can turn a grasped sheet by a desired angle, preferably by +/−90° or 180°. Rotated sheets can then be processed within the same printing line or can be transferred to another printing line.

Thereby, the rotor unit can be arranged serially with a further conveyor belt. For this purpose, a rotor unit is provided preferably with rotatably supported pneumatic conveyor belts. The conveyor device with the rotor unit can advantageously be arranged at the crossing point of two processing or printing lines and is embedded selectively into the one or the other transport path.

Alternatively, the rotor unit can interact with a conveyor belt and can receive sheets decoupled from the lower side of a conveyor belt, can turn the sheets and can deliver the sheets back to the lower side of the conveyor belt. Sheets guided along the first printing line and rotated sheets can advantageously be stored in a sheet buffer located at the crossing point of the first printing line and a second printing line and can be picked up again from the sheet buffer and can be transported further along the first or the second printing line.

In a further preferred embodiment the at least one conveyor belt, which is provided with air channels, is held by two shafts, of which at least one is designed as a pneumatic shaft that comprises a hollow with one or a plurality of air channels. The pneumatic shaft is connected to the pneumatic device in such a way, that air is transferable selectively into the one or the other direction through the pneumatic shaft, in order to pull or push sheets onto or off the conveyor belt. In this manner, further options result for advantageously handling and conveying the sheets.

In a preferred embodiment a pneumatic shaft is provided at least on the output side of the conveyor belt, i.e. the conveyor unit and forms a deflector, with which the transfer of the sheets is controllable by the control unit and the pneumatic unit in such a way, a) that, by emission of air, the sheets are pressed downwards and are released from the conveyor belt; or
b) that, by intake of air, the sheets are travelling around the pneumatic shaft and are deflected, or, if selected, returned along the upper side of the conveyor belt; or
c) that, without or with reduced emission of air, the sheets are released from the conveyor belt and are transported further in a straight line.

Hence, sheets can be released from the conveyor belt in such a way that they by an air flow can guided to a sheet buffer, by air suction can be deflected or returned back, or by interruption of the air flow can be forwarded along a straight line e.g. to a further conveyor belt or to the next workstation. By deflection elements or by the appropriate dosage of the air flow, the deflection function can be optimised in all three variations and can be adapted to the date of the sheets.

Hence, with the inventive conveyor device a conveyor system with one or a plurality of printing lines can be built in a simple manner and with a compact setup. Inventive conveyor devices can be installed between workstations and can be adapted to these workstations. Preferably, an interface is provided, which allows the inventive conveyor device to communicate and to exchange data with the neighbouring workstations. By means of these data, the conveyor can automatically be configured. Further, based on these data the working processes can be controlled. The conveyor system preferably comprises a higher-level control device, which observes and controls all routines and processes and the related local control units. Thereby it is possible to run sub-processes within the conveyor system. The user can load and unload individual inventive conveyor devices or their sheet buffers and operate processes with selectable functions and workstations upstream and downstream.

DESCRIPTION OF THE DRAWINGS

The invention is described below with reference to the drawings. Thereby show.

DETAILED DESCRIPTION OF THE INVENTION

Figure 1:
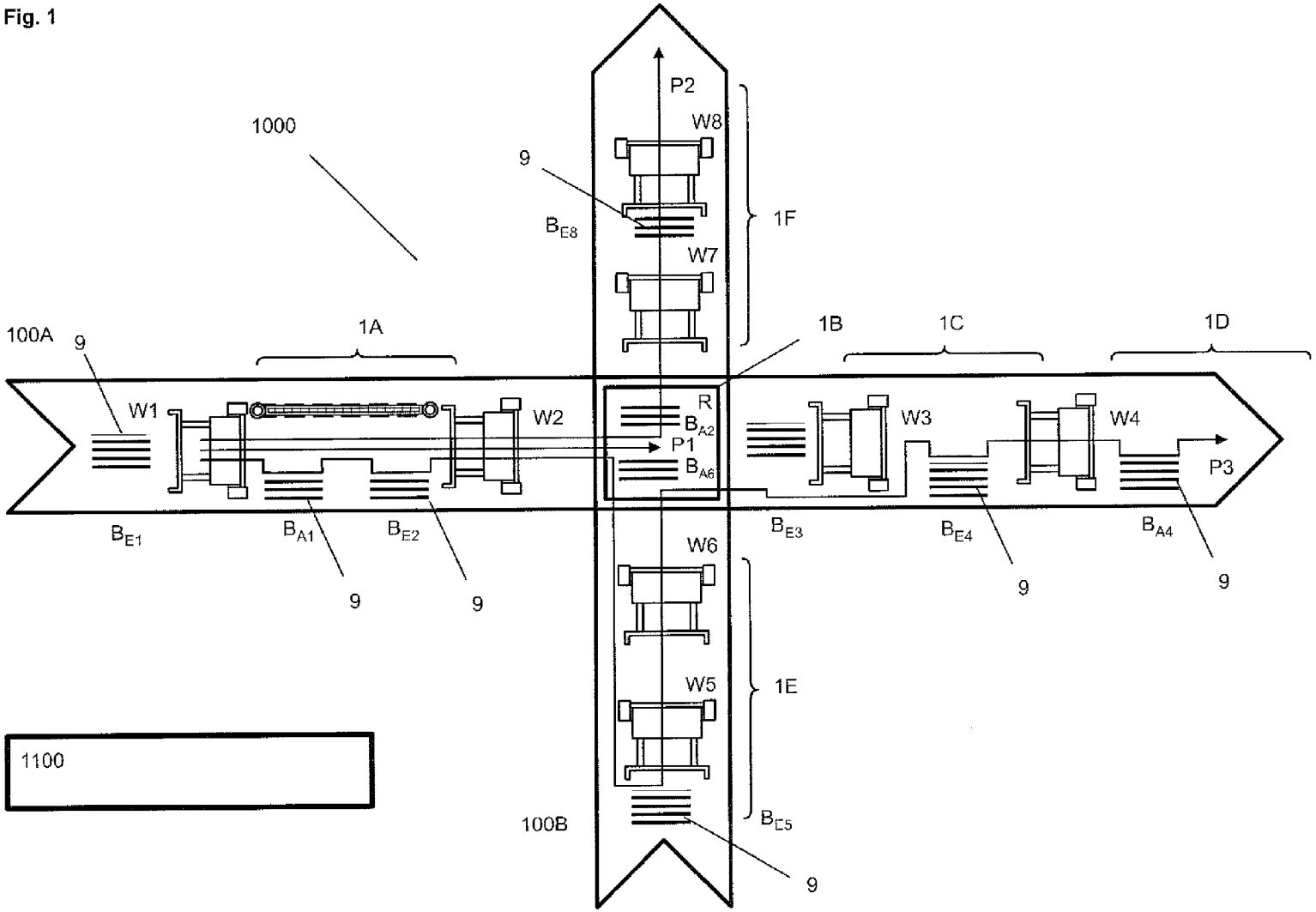
FIG. 1 a conveyor system 1000 with two printing lines 100A, 100B, that are crossing one another and that are equipped with inventive conveyor devices 1A, . . . , 1F, with which sheets 9 can selectively be transported between sheet buffers B and workstations W1, . . . , W8.

FIG. 1 shows a conveyor system 1000 with two processing lines or printing lines 100A, 100B that are crossing one another. The first printing line 100A is equipped with four workstations W1, W2, W3, W4, four inventive conveyor devices 1A, 1B, 1C, 1D and with sheet buffers $B_{E1}$, $B_{A1}$, $B_{E2}$, $B_{A2}$, $B_{A6}$, $B_{E3}$, $B_{E4}$, and $B_{A4}$ that are preferably all integrated in related conveyor devices 1A, 1B, 1C, 1D. The second printing line 100B is equipped with four workstations W5, W6, W7, W8, three inventive conveyor devices 1E, 1B, 1F and with sheet buffers $B_{E5}$, $B_{A6}$, $B_{A2}$ and $B_{E8}$ that are preferably all integrated in related conveyor devices 1E, 1B, and 1F.

One of the conveyor devices 1B with two sheet buffers $B_{A2}$, $B_{A6}$ integrated therein is located at the crossing point of the two printing lines 100A, 100B. Both sheet buffers $B_{A2}$, $B_{A6}$ can selectively be integrated into the processes or sub-processes of the two printing lines 100A, 100B. Hence, by means of the available sub-processes the user can selectively define production processes, with which sheets 9 can be processed.

FIG. 1 shows an example of three production processes P1, P2, P3. With the first production process P1, sheets 9 are transported in the first printing line 100A from sheet buffer $B_{E1}$ to the first workstation W1, e.g. a printing device. At the output of the first workstation W1 printed sheets 9 are gripped by the first conveyor device 1A and are routed by means of the bypass-function past the sheet buffers $B_{A1}$, $B_{E2}$ to the second workstation W2. Sheets 9 processed and delivered by the second workstation W2 are gripped by a second inventive conveyor device 1B, which is located at the crossing point of the first and the second printing line 100A, 100B, and are delivered to a sheet buffer $B_{A2}$. In the second sheet buffer $B_{A2}$, sheets 9 are stored, which for example are either kept ready for further processing in the first or second printing line 100A, 100B, or which have been examined and are not transported further due to a recognised deficiency. Hence, the sheet buffer $B_{A2}$ can be used as "stacker" for the second workstation W2 and as "feeder" for the subsequent workstation W7 in the second printing line 100B, as the illustrated production process P2 shows. The second conveyor device 1B comprises means with which the alignment of the sheets 9 can be changed as required, preferably in steps of 90°. In this way, sheets 9 can be delivered properly aligned to workstation W7.

With the third production process P3 sheets 9 are selectively taken from the first workstation W1 or one of the two sheet buffers $B_{A1}$, $B_{E2}$ and delivered to the second workstation W2. From the second workstation W2, sheets 9 are guided to the second conveyor device 1B, which forwards the sheets 9 to conveyor device 1E, which is arranged within the second printing line 100B. Sheets 9 are guided from the second conveyor device 1B to a fifth workstation W5 and further to a subsequent sixth workstation W6 and then to the second conveyor device 1B. Hence, two inventive conveyor devices 1B, 1E can also be connected with one another directly by a conveyor belt, in order to bridge one or a plurality of workstations W5, W6 or another distance along a printing line.

Figure 6:
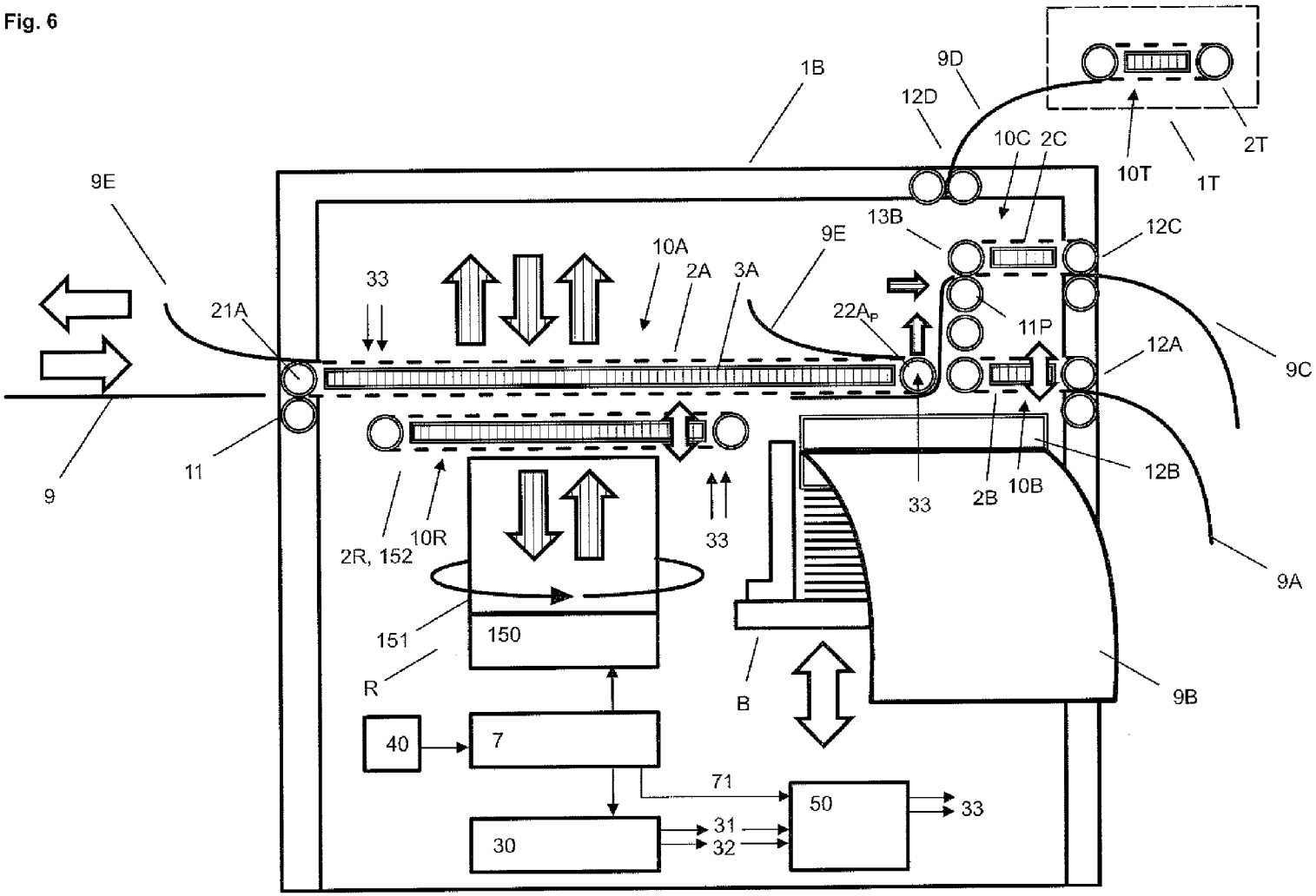
FIG. 6 an inventive conveyor device 1 in a preferred embodiment, with which sheets 9 can be rotated as desired and turned over and can be released at any side of the conveyor device 1.

FIG. 6 shows the second conveyor device 1B with a roller pair 12D, through which sheets 9D can be delivered upwards to a conveyor belt 2T, which preferably is part of an inventive conveyor device 1T. Sheets 9 can be transferred via conveyor device 1T from the second conveyor device 1B to conveyor device 1E. Production process P3 further transports the sheets 9 to the workstations W3 and W4 as well as to the further inventive conveyor devices 1C and 1D.

Figure 2:
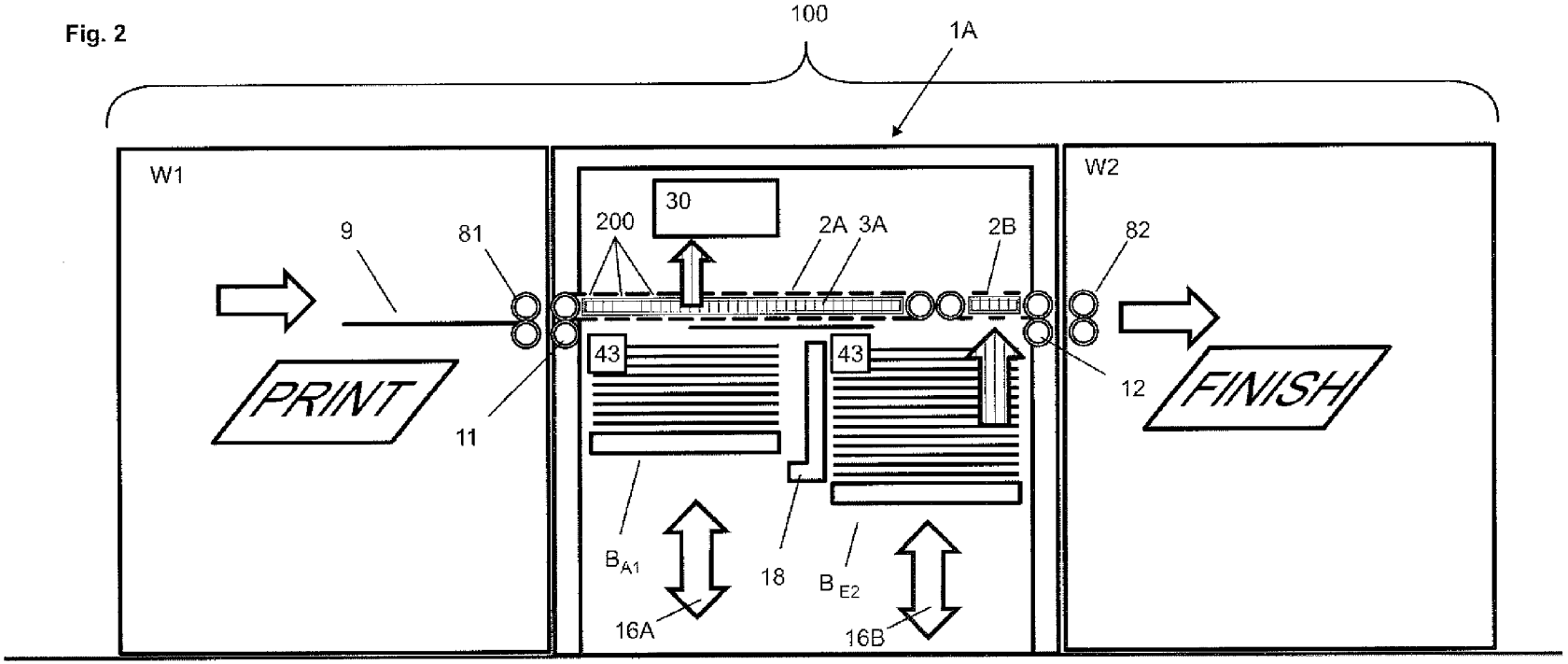
FIG. 2 the first inventive conveyor device 1A of FIG. 1, which connects the first and the second workstation W1, W2 with one another and which comprises a conveyor unit 10 as well as two sheet buffers $B_{A1}$, $B_{E2}$, that are arranged serially behind one another.

FIG. 2 shows the first inventive conveyor device 1A of FIG. 1, which connects the first workstation W1, e.g. a printing device, and the second workstation W2, e.g. a coating device or a folding device, with one another.

Figure 3:
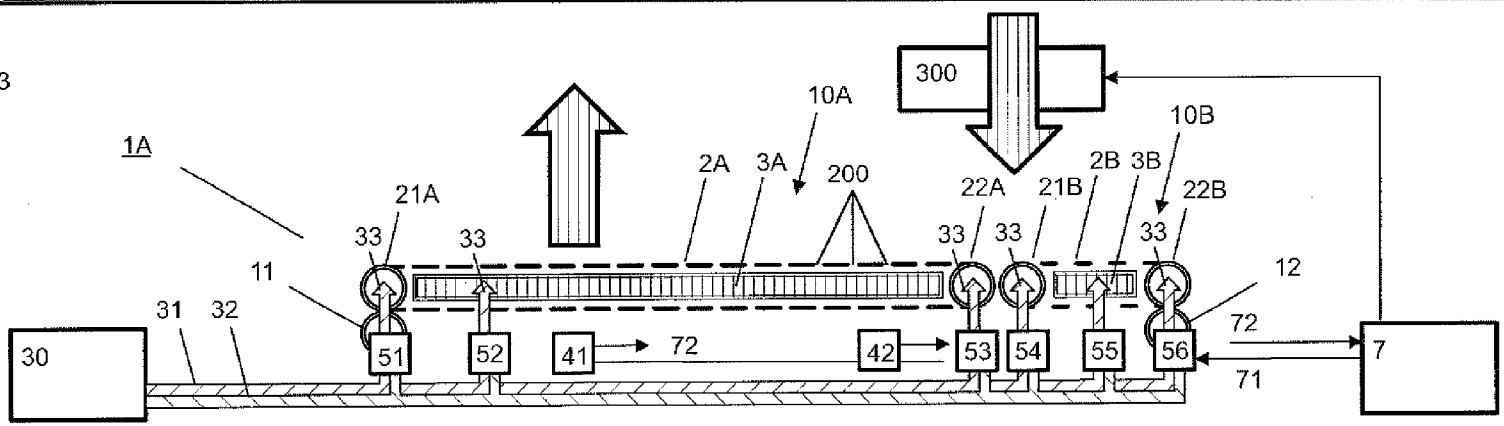
FIG. 3 the conveyor unit 10 of the conveyor device 1 of FIG. 2 in a preferred embodiment.

In this embodiment the conveyor device 1A comprises two conveyor units 10A, 10B shown in FIG. 3, which comprise conveyor belts 2A, 2B that are serially aligned behind one another and with which sheets 9 can be transported from the first to the second workstation W1, W2 or can selectively be placed in one of two sheet buffers $B_{A1}$, $B_{E2}$. Alternatively, sheets 9 can selectively be picked up from one of the two sheet buffer $B_{A1}$, $B_{E2}$ and can be transported to the second workstation W2.

The conveyor belts 2A, 23 are provided with air channels 200 and are held each by a set of two shafts 21A, 22A or 21B, 22B respectively. Further, pneumatic devices 3A, 3B are provided, that are connected to a pneumatic unit 30 which serves for the supply of air. The pneumatic unit 30 is connected with pneumatic lines 31, 32, through which air having excess pressure or underpressure can be guided to control units 51, . . . , 56 that are actuated by means of a control device 7. With the control units 51, . . . , 56, that comprise actuators and valves, one of the pneumatic lines 31, 32 can be connected to a related output line 33. The output line 33 of the control units 52 and 55 are connected to the pneumatic devices 3A, 3B, which suck air or blow air through the air channels 200 provided in the conveyor belt 2A and 2B. The control units 51, . . . , 56 can be integrated in one assembly 50 (see FIG. 6).

The control units 51 and 53 as well as 54 and 56 are connected to pneumatic output lines 33 that are guided to pneumatic shafts 21A, 22A and 21B, 22B, which hold the two conveyor belts 2A, 2B. Hence, with the control units 51, . . . , 56, which are controlled by the control device 71 via control lines 71, air can selectively be sucked or blown through the pneumatic shafts 21A, 22A and 21B, 22B and through the conveyor belts 2A, 2B. In this way, sheets 9 can selectively be coupled to or decoupled from the conveyor belts 2A, 2B and coupled to or decoupled from the pneumatic shafts 21A, 22A and 21B, 22B. These procedures are executed depending on the position of the transported sheets 9, wherefore sensors 41, 42 are provided, with which the position of the sheets 9 can be determined preferably optically. Measurement signals are forwarded from the sensors 41, 42 via measuring line 72 to the control device 7. Typically the appearance of the front edge or the rear edge of the sheet 9 is detected, in order to take appropriate action.

According to the invention, a sheet 9 delivered by the first workstation W1 or outputted by a corresponding output roller pair 81 of the workstation W1 this forwarded to the lower side of the first conveyor belt 2A and can there be grasped by the conveyor belt 2A, or even before by the pneumatic shaft 21A and can be transported further. In the same manner, the sheet 9 transported by the first conveyor belt 2A can be transferred to the lower side of the second conveyor belt 2B. For decoupling the sheet 9 the air flow guided through the conveyor belt 2A or 23 or through the pneumatic shafts 22A, 22B can be inverted.

In order to enable picking up and putting down the sheets 9 from and to the sheet buffers $B_{A1}$, $B_{E2}$, the sheet buffers $B_{A1}$, $B_{E2}$ are provided each with a table that serves for receiving a staple, which can be lifted or lowered with a drive device 16A, 16B that is schematically shown. With this arrangement the staple with sheets 9 held by the sheet buffers $B_{A1}$, $B_{E2}$, can be lifted upwards towards the first or second conveyor belt 2A, 2B, in order to pick up a sheet 9, and then be lowered again, in order to move the staple with sheets 9 away from the conveyor belt 2A, 2B. Sensors 43 are provided for measuring the distance between the conveyor belts 2A, 2B and the upper edge of the stapled sheets 9. When the optimal distance of the stapled sheets 9 relative to the conveyor belts 2A, 2B is reached, then the sensors 43 are sending corresponding signals to the control device 7.

In order to uniformly staple the sheets 9, an active or passive guiding element 18 is provided that lies adjacent to the staple or that can be guided against the staple, so that the sheets 9 are aligned on the front side and/or laterally.

Subsequently, stapled sheets 9 can be taken from the sheet buffers $B_{A1}$, $B_{E2}$ and can be guided with the conveyor device 2B via an output conveyor part 12, for example via an input roller pair 82 to the next workstation W2. Further, a sheet 9 delivered by the first workstation W1 can also be guided further directly to the second workstation W2.

Figure 4:
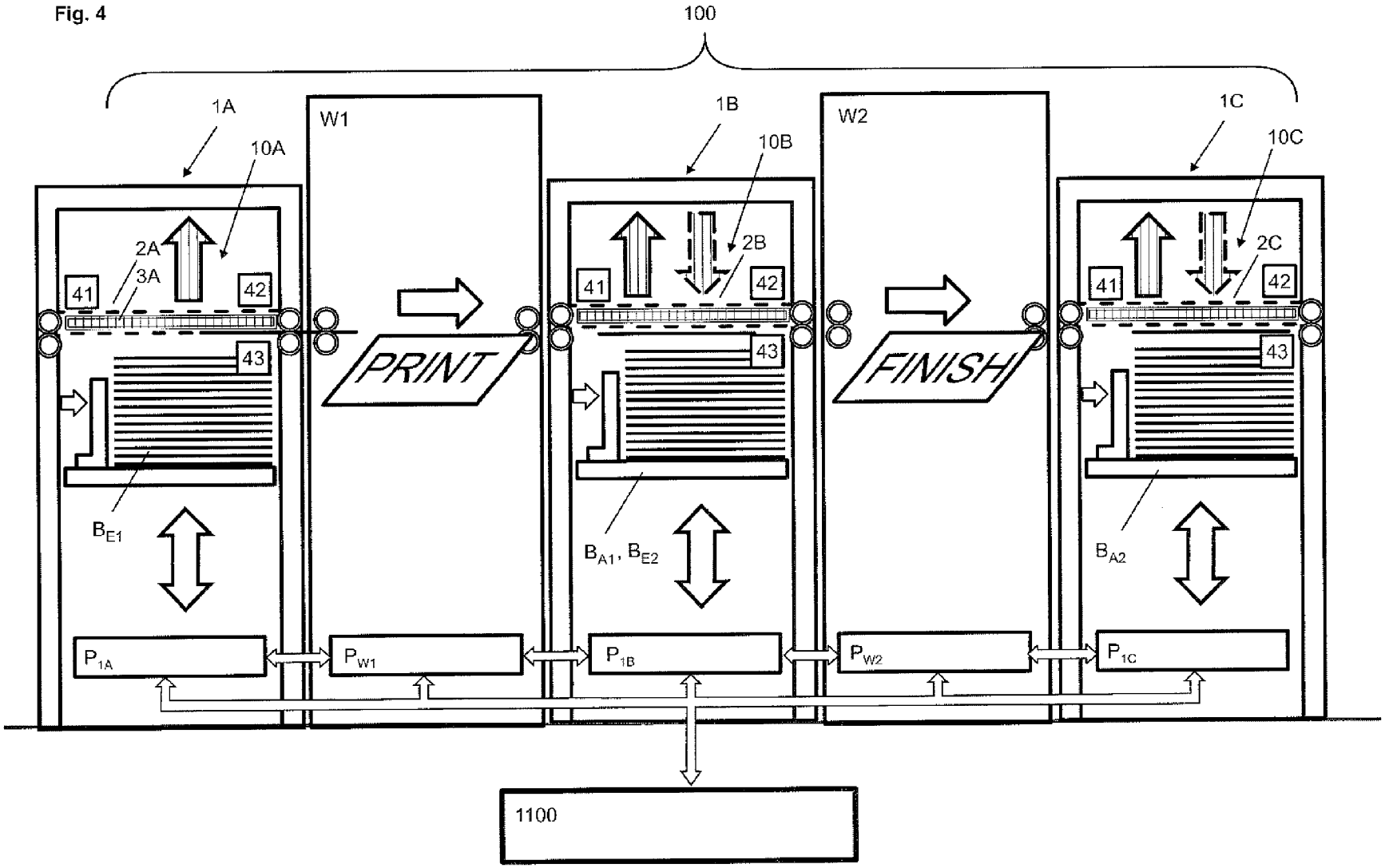
FIG. 4 a printing line 100 with the two workstations W1, W2 of FIG. 2, that are arranged between three identical inventive conveyor devices 1A, 1B, 1C, that each comprise one sheet buffer $B_{E1}$, $B_{A1}$ or $B_{E2}$, $B_{A2}$, only.

FIG. 4 shows a printing line 100 with the two workstations W1, W2 of FIG. 2 that are arranged between three identical inventive conveyor devices 1A, 1B, 1C, which comprise each only one sheet buffer $B_{E1}$, $B_{A1}$ or $B_{E2}$, $B_{A2}$, and only one conveyor unit 10A, 10B or 10C.

FIG. 4 illustrates, that inventive conveyor devices 1A, 1B, 1C can be employed as desired. Each of the conveyor devices 1A, 1B, 1C is equipped with one conveyor unit 10A, 10B, 10C that each comprises a conveyor belt 2A, 2B, 2C and a pneumatic device 3A, 3B, 3C. The first conveyor device 1A serves as feeder for the first workstation W1. The second conveyor device 1B serves as stacker for the first workstation W1 and simultaneously as feeder for the second workstation W2. The third conveyor device 1C serves as stacker for the second workstation W2. The sheet buffers $B_{E1}$, $B_{A1}$ or B or $B_{E2}$, $B_{A2}$ of the three conveyor devices 1A, 1B, and 1C fulfil the corresponding functions.

FIG. 4 shows further that the conveyor devices 1A, 1B, 1C and the workstations W1, W2 comprise each a local control unit $P_{1A}$, $P_{1B}$, $P_{1C}$ or $P_{W1}$, $P_{W2}$. In preferred embodiments, the local control units $P_{1A}$, $P_{1B}$, $P_{1C}$ or $P_{W1}$, $P_{W2}$ of neighbouring entities 1A, W1; W1, 1B; 1B, W2 of the printing line 100 are directly connected with one another via communication means, such as a data bus. In this preferred embodiment the local control units $P_{1A}$, $P_{1B}$, $P_{1C}$ or $P_{W1}$, $P_{W2}$ are connected in addition via a data bus with a central control unit 1100. Hence, the local control units $P_{1A}$, $P_{1B}$, $P_{1C}$ of the conveyor devices 1A, 1B, and 1C can retrieve data from neighbouring units, such as neighbouring workstations W1, W2 or neighbouring inventive conveyor devices 1 directly or indirectly and can configure themselves accordingly. Preferably wireless communication takes place, e.g. by means of the protocols of a mobile communication system, such as Bluetooth-systems. After establishing contact, the conveyor devices 1A, 1B, 1C and the workstations W1, W2 can form an (Ad hoc) network or can communicate wireless with the central control unit.

Figure 8:
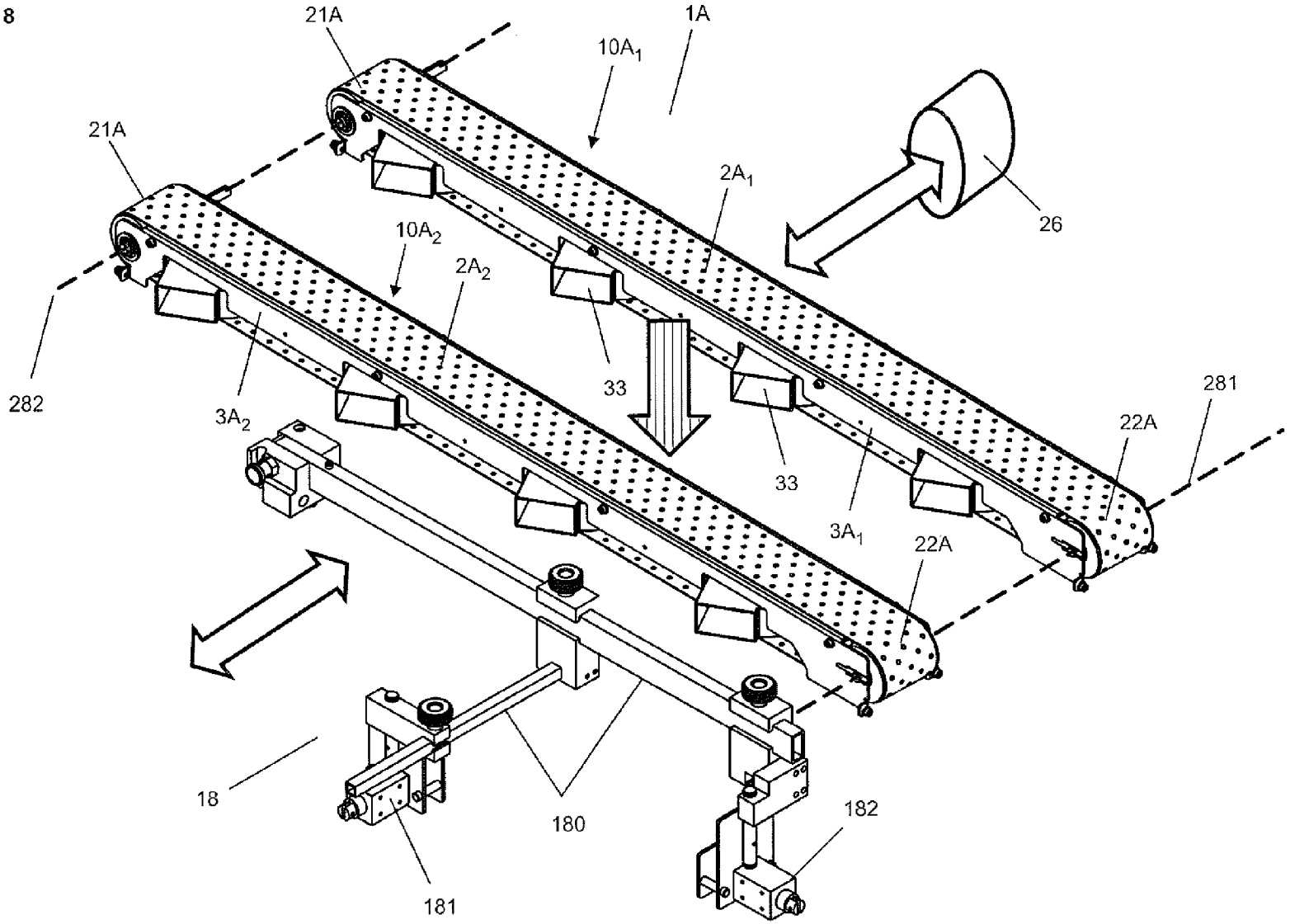
FIG. 8 a conveyor belt 2A with two parts 2$A_1$, 2$A_2$, that can be shifted towards one another.

Thereby, it is possible that corresponding protocols, particularly control protocols, are loaded. Further, adjustments or adaptation of the hardware, i.e. of the conveyor unit 10, is performed automatically. E.g., the conveyor device 1 recognises the settings of the workstations W1, W2 or the formats of the sheets 9 used and performs automatically the required adjustments. E.g., the distance between the conveyor belts $\mathbf{2}_{A1}$ and $\mathbf{2}_{A2}$ of the conveyor shown in FIG. 8 is automatically set.

Figure 5:
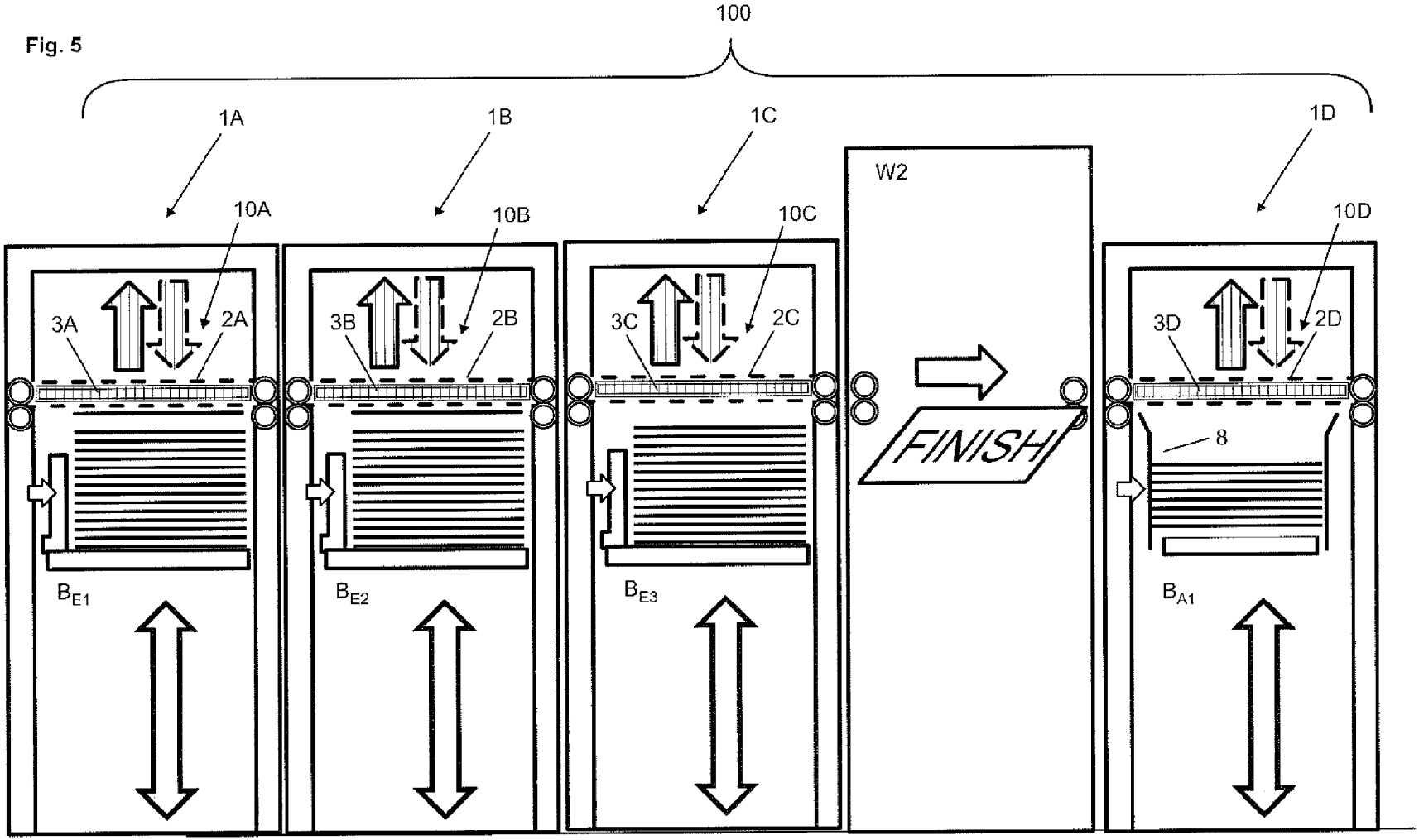
FIG. 5 the second workstation W2 of FIG. 2, with three inventive conveyor devices 1A, 1B, 1C installed upstream in series and with an inventive conveyor device 1D installed downstream.

FIG. 5 shows the second workstation W2 of FIG. 2 with three inventive conveyor devices 1A, 1B, 1C installed upstream in serious and an inventive conveyor device 1D installed downstream. Each of the conveyor devices 1A, 1B, 1C, 1D is equipped with one conveyor unit 10A, 10B, 10C, 10D that each comprise a conveyor belt 2A, 2B, 2C, 2D and a pneumatic device 3A, 3B, 3C, 3D. The conveyor devices 1A, 1B, 1C, which serve as feeders for the workstation W2, allow sorting of sheets 9 before they are supplied to the workstation W2. E.g., sheets 9 are alternatingly taken from the first two conveyor devices 1A, 1B and are forwarded to the third conveyor device 1C. In the conveyor device 1D installed downstream of the workstation W2 the sheets 9 are stapled. It is illustrated that this task can easily be performed with a duct 8, into which the supplied sheets 9 can be dropped. This process can be supported with the pneumatic device 3A that blows air into the duct 8 or that sucks air out of the duct 8, in order to generate a vacuum. Preferably, at least the side walls of the duct are movable, in order to align the sheets 9 on the staple laterally or on the front side.

FIG. 6 shows an extended embodiment of the second inventive conveyor device 1B of FIG. 1 that comprises several conveyor units 10A, 10B, 10C, 10T, 10R that each comprise a conveyor belt 2A, 2B, 2C, 2T, 2R and a pneumatic device 3A, 3B, 3C, 3T, 3R.

In this embodiment of the conveyor device 1B, sheets 9 can be rotated and turned over as desired and can be released at any side of the conveyor device 1B. The conveyor device 1B comprises a first central conveyor belt 2A that can deliver sheets 9 that are received via the input conveyor part 11 or picked up from a sheet buffer B, directly or via further conveyor belts 2B, 2C, to four different output roller pairs 12A, 12B, 12C, 12D. Via the output roller pairs 12A and 12C, the sheets 9A and 9C are outputted on the front side. Via the output roller pair 12C the sheets 9B are outputted laterally. Via the output roller pair 12D the sheets 9D are outputted upwards to a further conveyor device 1T or a conveyor belt 2T, which can transport sheets 9D to any desired point of the conveyor system 1000 and which has a corresponding length.

It is shown that the first conveyor belt 2A comprises a pneumatic shaft $\mathbf{22}A_P$ at the output side, which is connected via pneumatic lines 31, 32 and 33 and an assembly 50, that comprises pneumatic control units 51, 52, 53, . . . , with the pneumatic unit 30. Air flow can be guided through the pneumatic shaft $\mathbf{22}A_P$ into one and an inverse direction in order to suck sheets 9 towards the pneumatic shaft $\mathbf{22}A_P$ or blew sheets 9 away from the pneumatic shaft $\mathbf{22}A_P$. If no air is guided through the pneumatic shaft $\mathbf{22}A_P$, then the sheets 9 are conveyed in a straight line without changing the direction. Hence, the pneumatic shaft $\mathbf{22}A_P$ forms a deflector, with which the sheets 9 can be guided downwards to the sheet buffer B, straight on to the second conveyor belt 2B or upwards to the third conveyor belt 2C or to the output roller pair 12D. It is shown that on the front side of the third conveyor belt 2C an input conveyor part, i.e. a pneumatic shaft 11P is provided, with which sheets 9 can be sucked towards the lower side of the conveyor belt 2C or with which sheets can also be pushed away so that they are guided to the output roller pair 12D. It is further shown that sheets 9E can also be guided and turned around the pneumatic shaft $\mathbf{22}A_P$ by 180° and an can be transported back on the upper side of the first conveyor belt 2A and can be released again at the input side. Alternatively the sheets 9E that have been turned over and that are guided on the upper side of a pair of conveyor belts $\mathbf{2}A_1$, $\mathbf{2}A_2$ can also be conveyed downwards onto a sheet buffer B. FIG. 8 shows that between the conveyor belts $\mathbf{2}A_1$, $\mathbf{2}A_2$ an air flow can be introduced, in order to push the sheets 9E between the conveyor belts $\mathbf{2}A_1$, $\mathbf{2}A_2$ downwards. In this way, sheets 9E are turned and can be placed upside down onto the sheet buffer B.

Hence, the pneumatic shafts $\mathbf{22}A_P$ and 11P can advantageously be combined with the conveyor belts 2A, 2B and 2C of the inventive conveyor devices 1, 1B, in order to selectively control the coupling and decoupling of sheets 9 and to establish a desired transport path. Thereby, the air flows through the conveyor belt 2A and the pneumatic shaft $\mathbf{22}A_P$ can be combined as desired. While the conveyor belt 2A can attract a sheet 9, the pneumatic shaft $\mathbf{22}A_P$ can push off the same sheet 9. Further, the air flows guided through the conveyor belt 2A and through the pneumatic shaft $\mathbf{22}A_P$ can be synchronised. Further, an air flow can also be guided through the conveyor belt 2A or through the pneumatic shaft $\mathbf{22}A_P$ only, in a desired direction. Further, pneumatic shafts can be used as auxiliary shafts separated from the conveyor belts in order to direct sheets 9 in a presently selected direction.

The conveyor device 1B of FIG. 6 further comprises a rotor unit R that allows alignment of a sheet 9 in a plane as desired. E.g., in order to transfer the sheets 9 travelling along the first printing line 100A into the second printing line 100B, the sheets 9 are turned typically by +/−90°.

Thereby, a rotor unit R can be equipped with a conveyor belt 2R that receives sheets 9 delivered by a first conveyor belt 2X, rotates sheets 9 by a desired angle and delivers the sheets 9 to a second conveyor belt 2X. A rotor unit R of this embodiment can be installed at the crossing point of the two printing lines 100A, 100B shown in FIG. 1. Hence, an inventive conveyor device 1 can be equipped with one conveyor belt 2R or with a plurality of conveyor belts 2A, 2B, 2C, 2R, of which e.g. one can be rotatable. In the conveyor device 1B of FIG. 6 the conveyor belt 2A or the related conveyor unit can be replaced by the conveyor belt 2R or the related conveyor unit 10.

However, in the embodiment shown, the conveyor belt 2R is arranged below the conveyor belt 2A and can receive sheets 9 from the lower side of the conveyor belt 2A, and can turn and deliver the sheets back to the conveyor belt 2A. For this purpose, a turntable 152 can be used, with which sheets 9 are attracted, turned, stored and/or supplied. The rotor unit R comprises a rotor 151 that is driven by a motor 150. The handover of sheets 9 is controlled by the control device 7, which is connected to sensors 40 that indicate the position of the sheets 9. For the handover of the sheets 9, the conveyor belt 2A is preferably briefly stopped and the air flow through the conveyor belt 2A is inverted, so that a sheet 9 can be forwarded to the rotor unit R.

Figures 7A, 7B:
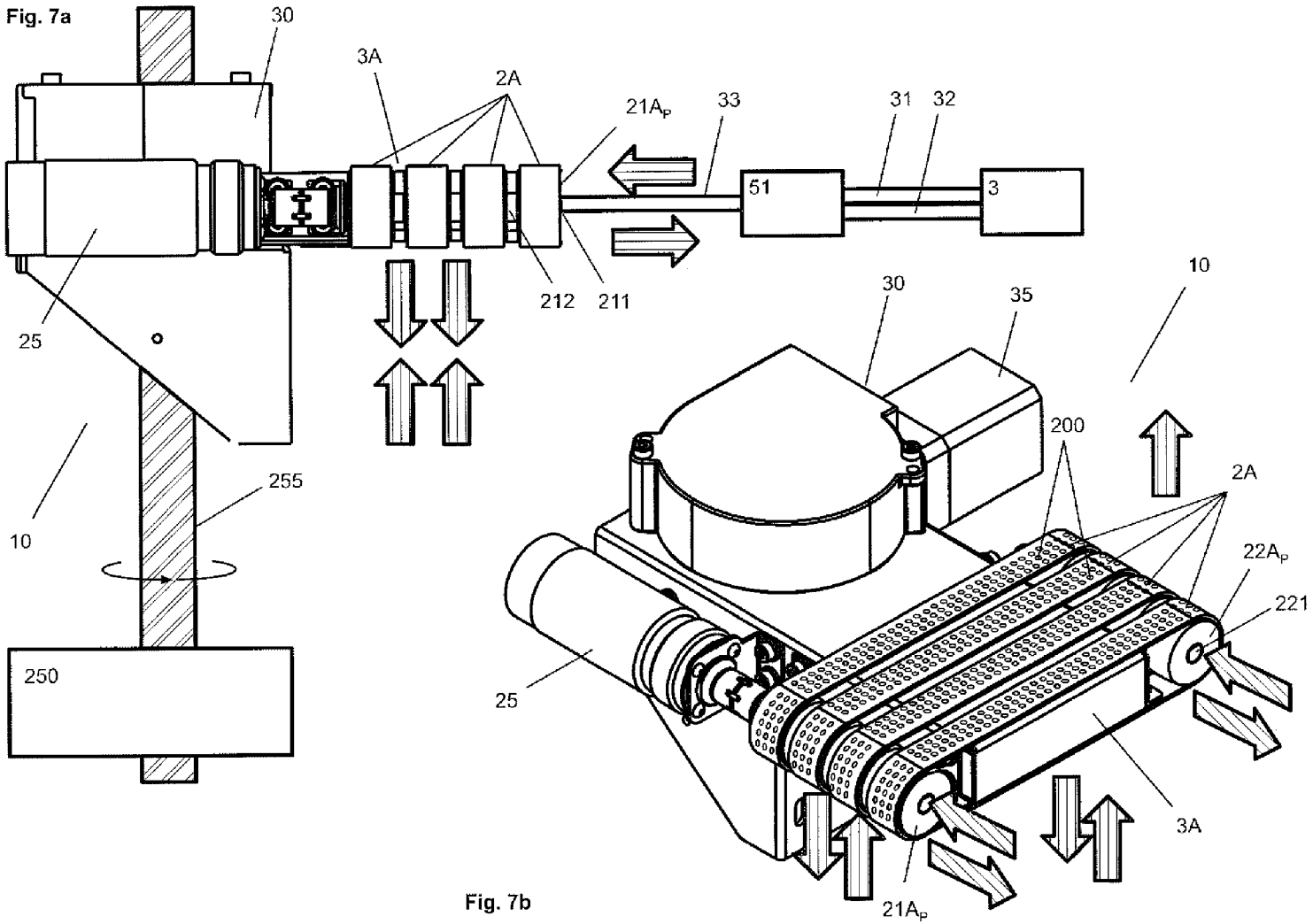
FIG. 7*a*, 7*b* two different views of a preferred conveyor unit 10 with a pneumatic device 3A with a pneumatic unit 30 that is connected or can be connected to the pneumatic conveyor belt 2A and also to two pneumatic shafts 21$A_P$, 22$A_P$ with which the conveyor belt 2A is held.

FIGS. 7*a* and 7*b* show two illustrations of a preferred conveyor unit 10, which comprises a pneumatic unit 30 that is equipped with two pneumatic shafts $21A_P$, $22A_P$ and that is connected to a pneumatic device 3A, that sucks air through the part of the conveyor belt 2A, which lies adjacent to the lower sides of the pneumatic shafts $21A_P$, $22A_P$.

FIG. 7*a* shows the supply of air pressure (excess pressure or underpressure) to the pneumatic shaft $21A_P$, that comprises an axial bore 221, into which a pressure line 33, e.g. a tube, is inserted. The air can exit through the openings 212, which are provided radially at the pneumatic shaft $21A_P$, which is driven by a motor 25. Arrows symbolise, that air is sucked in or blown out through the pneumatic shafts $21A_P$, $22A_P$ and through the conveyor belt 2A radially towards the outside or radially towards the inside.

In the embodiment shown, the conveyor unit 10 further comprises a drive motor 250 that turns a jackscrew 255, with which the conveyor belt 2A can be moved vertically downwards and upwards, in order to pick up or release sheets 9. FIG. 7*b* shows the pneumatic unit 30, which is driven by a motor 35.

FIG. 8 shows a conveyor device 1A with two conveyor units $10A_1$, $10A_2$ with conveyor belts $2A_1$, $2A_2$ that are aligned in parallel towards one another and that can be moved by means of a drive device 26 towards one another. Each of the conveyor belts $2A_1$, $2A_2$ is provided with air channels and surrounds a pneumatic device $3A_1$, $3A_2$, which can suck in or blow out air. Hence, a sheet 9 can be coupled to or decoupled from the lower side or the upper side of the conveyor belts $2A_1$, $2A_2$.

Further, a guide unit 18 with a holding device 180 is shown that holds control members 181, 182 laterally and on the front side. Preferably a guide unit 18 is connected to each of the parts $2A_1$, $2A_2$, that with shifting of the two parts $2A_1$, $2A_2$ is automatically adapted to the width of the sheets 9.

REFERENCED DOCUMENTS

[1] JP4327996
[2] US2008157466A1
[3] US2007120934A1
[4] U.S. Pat. No. 5,979,890A
[5] DE102007024916A1

LIST OF REFERENCES

B sheet buffer
R rotor unit
P local control units
W workstation
1 conveyor
10 conveyor unit
100 printing line
1000 conveyor system
1100 central control unit
11 input device
12 output device
150 motor
151 rotor
152 turntable
16A, 16B buffer drives
18 guide unit
180 holding device
181 lateral control member
182 front sided control member
2A, 2B, . . . conveyor belt
2R turntable with conveyor belt
200 air channels
21, 22 shafts
$21A_P$, $22A_P$ pneumatic shafts
211, 212 air channels in den pneumatic shafts $21A_P$, $22A_P$
25 motor for driving the conveyor belt 2A
250 motor for driving the jackscrew
255 jackscrew
26 motor for the adjustment of the conveyor belt 2A
281, 282 translatory axes
3A, 3B, . . . pneumatic devices
30 pneumatic unit
300 transfer blower
31, 32, 33 pneumatic lines
35 drive motor for the pneumatic unit 3A
40, 41, 42 sensors
50 control assembly
51, . . . , 56 control units, actuators and valves
7 control device
71 control line
72 measuring line
8 duct
81 output roller pair
82 input roller pair
9 sheets

The invention claimed is:

1. Device for conveying sheets of paper, cardboard, or plastic along a transport path, the device comprising:

a control device configured to control a conveyor process;

at least a first conveyor belt provided with first air channels; and at least one pneumatic device connected to the first air channels of the conveyor belt, the control device being configured to actuate the pneumatic device, which is configured to transfer air through the first air channels so that sheets forwarded from an input device are pneumatically coupleable to and de-coupleable from the conveyor belt at an output device (12), wherein in a transport path between the input device and the output device, at least a first intermediate buffer is arranged, the first intermediate buffer being configured to receive and deliver said sheets; and the input device, the output device, and the first intermediate buffer are positioned adjacent to the first conveyor belt and operated by the control device in such a way that sheets forwarded from the input device or sheets stocked in the first intermediate buffer are coupleable pneumatically to a lower side of the first conveyor belt, and that sheets pneumatically attached to the lower side of the first conveyor belt are selectively decoupleable at the intermediate buffer or at the output device.

2. The device according to claim 1, wherein the first intermediate buffer and a second intermediate buffer interact with the first conveyer belt or a second conveyor belt so that (i) sheets provided by the input device are transportable selectively to the first intermediate buffer, the second intermediate buffer, or the output device, and (ii) sheets provided by the first intermediate buffer or the second intermediate buffer can selectively be transported to the output device.

3. The device according to claim 1, wherein the first conveyor belt and a second conveyor belt are positioned serially along the transport path behind one another, and wherein at least the first conveyor or the second conveyor belt is movable in a vertical direction in such a way that (i) sheets are coupleable from the input device, the first intermediate buffer, or the second intermediate buffer to the lower side of the first conveyor belt or the second conveyor belt, or sheets are decoupleable from the lower side of the first conveyor belt or the second conveyor belt at the first intermediate buffer, the second intermediate buffer, or the output device.

4. The device according to claim 1, wherein within the transport path of the sheets, at least one rotor unit is provided that selectively serves as input device for receiving or delivery sheets and that comprises a rotatable rotor that is connected to a motor and that comprises a turntable, with or without a conveyor belt, which allows pneumatically coupling, rotating, and decoupling sheets.

5. The device according to claim 1, wherein the first conveyer belt is held by at least one pneumatic shaft that comprises and axial bore and one or a plurality of second air channels that are connected to the pneumatic device in such a way that air the can be transferred to the pneumatic shaft through the axial bore and through the second air channels of the pneumatic shaft in order to pull or offload sheets to or off the pneumatic shaft.

6. The device according to claim 5, wherein the pneumatic shaft is provided at an output side of the first conveyor belt and forms a deflector, with which the transfer of the sheets is controllable by the control unit and the pneumatic in such a way that:

a) by emission of air, the sheets are pressed downwards and are released from the first conveyor belt;

b) by intake of air, the sheets are travelling around the pneumatic shaft and are deflected or, if selected, returned along an upper side of the first conveyor belt; or c) without or with reduced emission of air, the sheets are released from the first conveyor belt and are transported further in a straight line.

7. The device according to claim 1, wherein the first conveyor belt and a second conveyor belt are aligned in parallel to one another and are laterally movable against one another driven by a drive unit.

8. The device according to claim 7, wherein a transfer blower is arranged between the first conveyor belt and the second conveyor belt in such a way that air emitted by the transfer blower is directed against the sheets transported on the first conveyor belt and the second conveyor belt.

9. Conveyor system with at least a first printing line, the conveyor system comprising:

at least two workstations; and the conveyor device according to claim 1 arranged between the at least two workstations for transporting sheets from a first one of the workstations to a second one of the workstations.

10. The device according to claim 1, wherein each sheet buffer is provided with a table that serves for receiving a staple of sheets and that can be lifted or lowered with a drive device for receiving or delivering a sheet.

11. The device according to claim 1, wherein each conveyor belt can be moved vertically upwards and downwards in order to pick up or release a sheet.

* * * * *